US010003869B2

(12) United States Patent
Bogdanov et al.

(10) Patent No.: US 10,003,869 B2
(45) Date of Patent: Jun. 19, 2018

(54) PERFORATED PHASE ALIGNMENT TWEETER SCREEN

(71) Applicant: Paradigm Electronics Inc., Mississauga (CA)

(72) Inventors: Oleg Bogdanov, Toronto (CA); Alana Alty, Oakville (CA)

(73) Assignee: Paradigm Electronics, Inc., Mississauga, Ontario (CA)

( * ) Notice: Subject to any disclaimer, the term of this patent is extended or adjusted under 35 U.S.C. 154(b) by 0 days. days.

(21) Appl. No.: 14/986,840

(22) Filed: Jan. 4, 2016

(65) Prior Publication Data

US 2016/0198256 A1 Jul. 7, 2016

Related U.S. Application Data

(60) Provisional application No. 62/099,935, filed on Jan. 5, 2015.

(51) Int. Cl.

| | |
|---|---|
| ***H04R 1/02*** | (2006.01) |
| ***H04R 1/28*** | (2006.01) |
| ***H04S 7/00*** | (2006.01) |

(52) U.S. Cl.

CPC ..... *H04R 1/023* (2013.01); *H04R 1/2842* (2013.01); *H04S 7/00* (2013.01); *H04R 2201/34* (2013.01); *H04S 2420/01* (2013.01)

(58) Field of Classification Search

CPC ..... H04R 1/023; H04R 1/2842; H04R 1/345; H04R 2201/34

See application file for complete search history.

(56) References Cited

U.S. PATENT DOCUMENTS

| | | | | |
|---|---|---|---|---|
| D472,240 | S | 3/2003 | Seog | |
| 7,316,290 | B2 | 1/2008 | Hutt et al. | |
| D573,980 | S | 7/2008 | Nakane et al. | |
| D695,717 | S | 12/2013 | Carpenter et al. | |
| 8,989,419 | B2 | 3/2015 | Graber et al. | |
| 2013/0228393 | A1* | 9/2013 | Sterling ..... | H04R 1/345 181/150 |

* cited by examiner

*Primary Examiner* — Matthew Eason

(74) *Attorney, Agent, or Firm* — Boyle Fredrickson, S.C.

(57) ABSTRACT

A protective screen for a diaphragm of a loudspeaker comprises a first side and a second side. The screen comprises a perforated region and an imperforated region. The perforated region comprises a first perforation having a first size and a second perforation having a second size, each perforation passing through the first side and the second side of the screen, and each perforation allowing sound waves radiated from a first portion of the diaphragm to pass through the screen. The imperforated region suppresses sound waves radiated from a second portion of the diaphragm. The first perforation is more adjacent to the imperforated region than the second perforation, and wherein the second size of the second perforation is bigger than the first size of the first perforation.

20 Claims, 2 Drawing Sheets

PERFORATED PHASE ALIGNMENT TWEETER SCREEN

CROSS-REFERENCE TO RELATED APPLICATION

This application claims priority based on U.S. Patent Application No. 62/099,935 entitled "PERFORATED PHASE ALIGNMENT TWEETER SCREEN" filed Jan. 5, 2015, the subject matter of which is incorporated herein by reference in its entirety.

FIELD OF THE INVENTION

The invention relates to loudspeakers, and in particular, a protective screen integrating with a phase plug for a diaphragm of a loudspeaker, including a tweeter.

BACKGROUND

A tweeter is used to produce high audio frequencies, typically from around 2 KHz to around 20 KHz. High frequency sound waves are created by the vibration of the air by a diaphragm of the tweeter. The diaphragm of the tweeter generally is light and stiff in order to have frequency response extending to the upper range of human hearing around 20 kHz. Best performing diaphragms are made of thin metal sheet, such as Aluminum, Titanium, Beryllium or sometimes ceramic. Due to the mass constraints, the thickness of a diaphragm is typically a few hundredth of a millimeter. This makes the diaphragm very fragile. Therefore, there is a need to put a protective screen in front of the diaphragm to prevent accidental damage from foreign objects coming into contact with the diaphragm of the tweeter.

On the other hand, as frequencies of sound waves radiated by the diaphragm increase, the lengths of the sound waves decrease and at some points become comparable to the size of the diaphragm. Sometimes, due to different distances between the position of the listener and different portions of the diaphragm, the sound waves radiated from different portions of the diaphragm reach the position of a listener at slightly different times. As a result, the phases of the sound waves reached the position of the listener may be misaligned. Due to the phases misalignment, the amplitudes of these sound waves sometimes add up when they are in phase or subtract when out of phase. This creates unevenness in frequency response of the sound waves received by the listener.

Phase plugs are commonly used to improve the unevenness in frequency response caused by phases misalignment of the sound waves. For example, sound waves from certain portions of the diaphragm of the loudspeaker can be suppressed by a phase plug to reduce the effect of phase misalignments of sound waves received by the listener, and thus to improve the unevenness in frequency response.

Sometimes, an assembly combining a tweeter screen and a phase plug is used to both protect the diaphragm and mitigate sound wave, phase misalignment. However, the assemble requires the screen and the phase plug to be manufactured separately. In use, the screen and the phase plug need to be assembled, for example, by adhesives. In addition, the assemble may not be reliable as the screen and the phase plug may be detached from each other due to the failure of the adhesives.

SUMMARY OF THE INVENTION

The invention proposes a perforated protective screen with a special pattern acting both as a protective screen and a phase plug.

An objective of the present invention is to improve frequency response and sound radiation pattern.

Another objective of the present invention is to improve the manufacturability and reliability of a protective screen and a phase plug.

In an embodiment, there is provided a protective screen for a diaphragm of a loudspeaker, the screen comprising:

A first side and a second side;

A perforated region comprising a first perforation having a first size and a second perforation having a second size, each perforation passing through the first side and the second side of the screen, and each perforation allowing sound waves radiated from a first portion of the diaphragm to pass through the screen;

An imperforated region to suppress sound waves radiated from a second portion of the diaphragm; and Wherein the first perforation is more adjacent to the imperforated region than the second perforation, and wherein the second size of the second perforation is bigger than the first size of the first perforation.

In a further embodiment, there is provided a protective screen for a diaphragm of a loudspeaker, the screen comprising:

A first side and a second side;

A perforated region comprising a plurality of perforations allowing sound waves radiated from a first portion of the diaphragm to pass through the screen, each perforation having a size and passing through the first side and the second side of the screen;

A imperforated region to suppress sound waves radiated from a second portion of the diaphragm; and Wherein sizes of the plurality of the perforations decrease from a periphery of the screen toward the imperforated region.

In a further embodiment, there is provided a protective screen, wherein the sizes of the plurality of the perforations gradually decrease from a periphery of the screen toward the imperforated region.

In a further embodiment, there is provided a loudspeaker assembly, comprising a protective screen, the protective screen comprising:

A first side and a second side;

A perforated region comprising a plurality of perforations allowing sound waves radiated from a first portion of the diaphragm to pass through the screen, each perforation having a size and passing through the first side and the second side of the screen;

A imperforated region to suppress sound waves radiated from a second portion of the diaphragm; and Wherein sizes of the plurality of the perforations decrease from a periphery of the screen toward the imperforated region.

In a further embodiment, there is provided a loudspeaker assembly, comprising a protective screen of the present invention, the protective screen is securely mounted in front of the diaphragm at a distance of several millimeters varying from periphery to the apex of the screen.

DETAILED DESCRIPTION OF EMBODIMENTS

Particular embodiments of the present invention will now be described with reference to the drawings. It will be understood by the skilled reader, however, that various modifications to the embodiments described herein are possible. Such modifications are intended to fall within the scope of the present invention, which is described by the claims.

Figure 1:
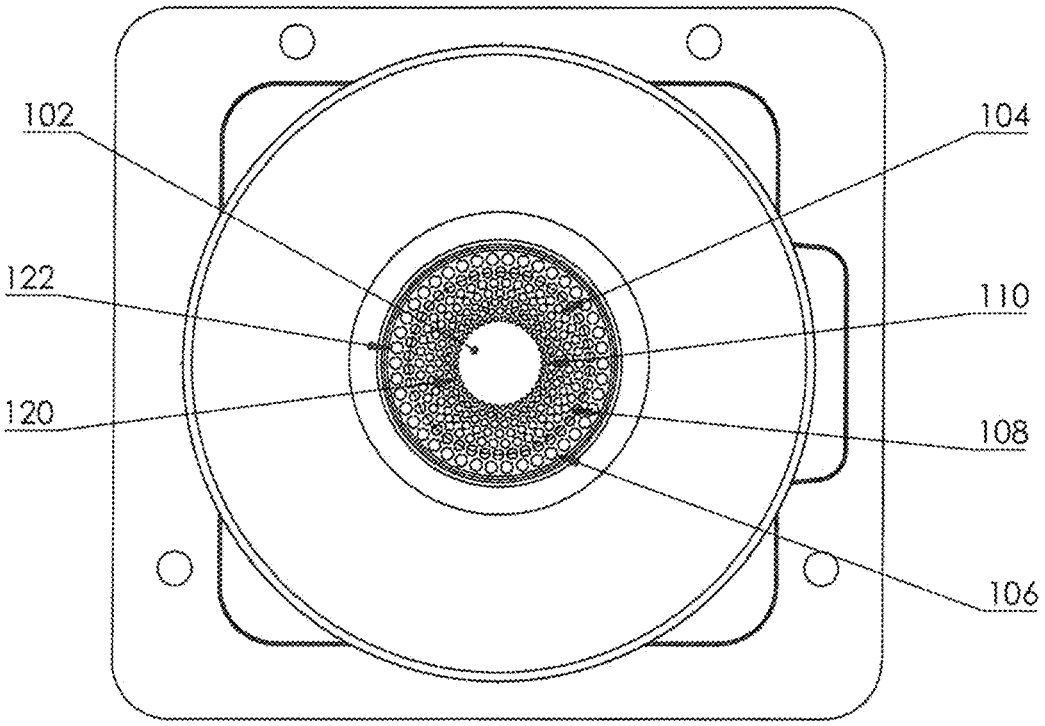
FIG. 1 is a perspective view of a protective screen according to an embodiment of the present application.

FIG. 1 illustrates a protective screen 100 to protect a diaphragm of a loudspeaker, including a high frequency loudspeaker. The protective screen 100 prevent foreign objects from accidental damage to the diaphragm. The size of the screen should fully cover the diaphragm. As well, the protective screen 100 also functions as a phase plug to mitigate the unevenness in frequency response caused by phases misalignment of the sound waves.

The protective screen 100 has an outer surface facing a listener and an inner surface facing the diaphragm of the loudspeaker. The protective screen 100 comprises an imperforated region 102 and a perforated region 104. The imperforated region 102 and the perforated region 104 are adjacent to each other.

The imperforated region 102 in the example of FIG. 1 effectively acts as a phase plug. The imperforated region 102 is solid. In the example of FIG. 1, the imperforated region is located substantially at the central region of the diaphragm, with perforations 106, 108, or 110 on the perforated region 104 around the imperforated region 102. In another embodiment, the imperforated region 102 may be a solid ring with a central opening. Because sound waves at the central region of the diaphragm generally arrive at the listener slightly earlier than those close to the periphery region of the diaphragm, the imperforated region 102 in FIG. 1 placed in front of the diaphragm properly acts to suppress the sound waves radiated from the central region of the diaphragm. By suppressing the earlier sound waves radiated from central region of the diaphragm, the imperforated region 102 mitigates the phase misalignment of the sound waves received by the listener, and thus improves the unevenness of the frequency response of the sound waves. Although the shape of the imperforated region 102 in FIG. 1 is substantially circular, the imperforated region 102 may also have other shapes such as ellipsoid, polygons, etc.

The size of the imperforated region 102 is determined by geometry of the diaphragm and the distance from the diaphragm to the screen. The distance should be minimized but still allowing enough distance for diaphragm movement. Imperforated portion typically covers about half (measured by diameter) of the diaphragm. This is used as a starting point and further refinement is determined by acoustic measurements.

The perforated region 104 comprises a plurality of perforations, for example, perforations 106, 108, and 110 in FIG. 1. Each of the perforations passes through the outer surface and the inner surface of the protective screen 100. The perforations allow the sound waves radiated from the diaphragm to pass through the protective screen 100 to reach the listener. The perforations are so arranged on the perforated region 104 that the sizes of the perforations decrease from the periphery of the screen 100 toward the imperforated region 102. In the example of FIG. 1, on the perforated region 104, perforation 106 adjacent to the periphery of the protective screen 100 have bigger sizes than those of perforations 108 or 110, which are closer to the imperforated region 102 than perforation 106. The shapes of the perforations may be circular as shown in FIG. 1, ellipsoidal, polygons, or any combinations thereof.

FIG. 1 shows an example of a pattern to arrange the perforations on the perforated region 104. In the example of FIG. 1, the imperforated region 102 is substantially circular and located substantially at the centre of the protective screen 100. From the periphery of the screen 100 toward the imperforated region 102, the perforations on the perforated region 104 are arranged on a set of concentric circular rings surrounding the imperforated region 102. For every two adjacent rings, the sizes of the perforations on the ring close to the periphery of the screen 100 are bigger than those of the ring close to the imperforated region 102. As well, in the example of FIG. 1, the sizes of the perforations on a ring are substantially the same. The sizes of the perforations in a ring may also be different, for example, to maintain the open area ratio of the ring. From an outer ring adjacent to the periphery of the protective screen 100, such as ring 120, to an inner adjacent to the imperforated region 102, such as ring 122, the sizes of the perforations on the outer ring are larger than the sizes of the perforations on the inner ring.

The number of the rings an the perforated region 102 can be varied. The maximum number of rings on the perforated region 102 involves several factors. The number of rings of the perforated region 102 considers the overall size of the protective screen 100, the size of the imperforated region 102, the minimum size of a perforation that can be manufactured, the material of the screen, the thickness of the screen 100, and amount of material left to keep structural integrity of the screen 100 on the outermost ring. As one of the functions of the protective screen 100 is to protect the diaphragm underneath, the perforated screen 100 cannot be too fragile. In the example of FIG. 1, the diameter of the protective screen 100 is about 33 mm with 7 rings of perforations, and the thickness of the aluminum screen is about 1 mm.

The size of a perforation on each ring is determined by an open area ratio of the open area of a ring relative to overall area of the ring. More rings result in more gradual changes in open area ratios. Once the areas of the overall screen and the area of the imperforated region 102 are determined, the area of the perforated region 104 can be determined. The number of the rings on the perforated area 104 is then determined based the material of the screen 100, the thickness of the screen 100, the minimum size of the perforations that can be manufactured, and the structural integrity of the screen 100. Accordingly, the area of each ring can be determined. The area of the perforations on each ring can be further determined based on the selected open area ratio for each ring. In the example of FIG. 1, the diameter of the protective screen 100 is about 33 mm, the imperforated region 102 has a diameter about 12.5 mm, and the perforated region 104 comprises 7 rings of perforations. The imperforated region 102 has a ratio of 0, since the area of the open area is 0. For the innermost ring close to the imperforated region 102, the open area ratios is about 0.5, the overall area of the innermost ring is 40.8 square millimeters, the open area is 22.7 square millimeters, and therefore, the size of each perforation is 0.85 mm diameter circle. The open area ratio gradually increases and reaches around 0.8 for the outermost ring, the overall area of the outermost ring is 173 square millimeters, the open area is 132 square millimeters, and therefore, the size of each perforation is 2 mm diameter circle.

The changes of the open area ratios from innermost ring to the outermost ring may be a fixed step. For example in FIG. 1, the step is 0.05, namely the open area ratios of the 7 rings from outermost ring to the innermost ring are 0.8, 0.75, 0.7, 0.65, 0.6, 0.55, 0.5, the difference between every two adjacent rings being 0.05. The step of the open area ratios between every two adjacent rings may also be variable, for example, 0.02, 0.05, 0.1, 0.2, etc.

The shape of the perforations in the example of FIG. 1 is circular. The perforations of the present invention may also be other shapes, such as ellipsoid, or polygon.

The perforations on the perforated region 104 may be arranged in any other patterns as long as the sizes of the perforations decrease gradually from the periphery of the protective screen 100 towards the imperforated region 102. For example, the perforations may be arranged radially on the perforated region 104, with the sizes of the perforations gradually become bigger from the imperforated region 102 toward the periphery of the protective screen 100.

Generally, the shape of the protective screen 100 substantially corresponds with the shape of the diaphragm of the loudspeaker behind the protective screen 100. For example, for dome shaped diaphragms, as shown in the example of FIG. 1, convex dome shape screens may be used. Concave screens are suitable for conical or concave diaphragms. Finally, flat screens can also be used for flat diaphragms.

To protect the diaphragm underneath the protective screen 100, the material used to make the screen 100 must be stiff enough to provide sufficient structural integrity. In addition to sufficient stiffness, the materials of the protective screen 100 have resonant modes which generally occur only when sound wave frequencies are above 20 kHz. Suitable materials may be, for example, metals, such as aluminium, steel, titanium, magnesium and beryllium, as well as various alloys thereof. The materials of the screen 100 may also be Polymer. As different materials have different stiffness, less stiff materials need to be thicker to provide comparable stiffness as other stiffer materials. For example, screen made of polymers are generally thicker than those made of metals to provide comparable rigidity. However, the screen cannot be too thick, since excessive thickness can lead to degradation of sound transmission. In the example of FIG. 1, the protective screen is made of Aluminum and about 1 mm thick.

Unlike conventional phase plug with abrupt edges, the phase plug (the imperforated region 102) appears gradually with the decrease of the sizes of the perforations from the periphery of the screen toward the imperforated region 102. The protective screen 100 shows improved frequency response and sound radiation pattern.

Figure 2:
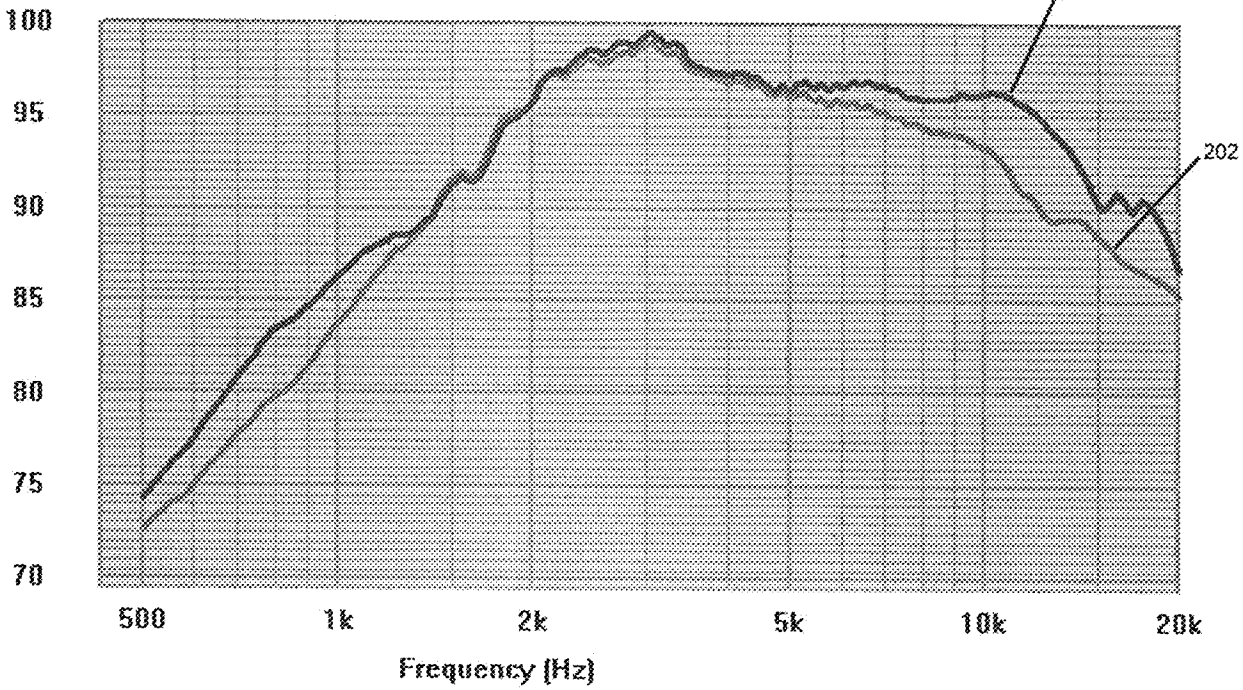
FIG. 2 is a diagram showing average frequency response in front hemisphere of a high frequency loudspeaker driver with conventional phase plug comparing with an improved phase plug integrated with the protective screen of the present invention.

For example, in FIG. 2, line 202 shows an average front hemisphere frequency response of a high frequency loudspeaker driver with a conventional phase plug. Line 204 illustrates a frequency response of the same loudspeaker with the phase plug of the protective screen 100. It can be seen from FIG. 2 that the amplitudes of line 204 are relatively more even than those of line 202 in higher frequency range, especially from 5 KHz to 18 KHz. Generally, the more perforations on the perforated region provide more even sound distribution.

As well, the phase plug (imperforated region 102) of the protective screen 100 also improves sound radiation pattern. In particular, the phase plug (imperforated region 102) of the protective screen 100 also shows less difference between on and off-axis frequency response compared to conventional phase plug with abrupt edges.

In addition, unlike an assembly attaching a phase plug to a tweeter screen, the protective screen 100 of the present invention comprises only a single component, which functions both as a protective screen to protect the diaphragm and a phase plug to mitigate sound waves phase misalignment issue. As such, the protective screen 100 simplifies manufacturing and assembling processes by reducing the components to be manufactured from two separate pieces, namely, a screen and a phase plug, to only one piece, namely, a protective screen integrating a phase plug, and therefore, the process of assembling the protective screen with the phase plug is no longer necessary. As well, the reliability of the protective screen 100 is also improved, as it does not require to attach the phase plug with the screen with adhesive in an assembly and therefore avoids incidental detachment of the phase plug from the screen due to the failure of the adhesive during operation of the loudspeaker.

In use, the screen 100 is securely mounted in front of the diaphragm of the loudspeaker. The distance between the protective screen 100 and the underneath diaphragm affects the functionality of the phase plug. If the distance between the protective screen 100 and the underneath diaphragm is too far, the plug may be ineffective as the phase plug will only block relatively small angular sector of the diaphragm. If the distance between the protective screen 100 and the underneath diaphragm is too close and diaphragm will come into contact with the screen and produce unwanted noise. The distance between the diaphragm and the mounted protective screen 100 is set to allow sufficient room for diaphragm movement, and to allow sufficient suppression of the sound waves radiated from the portion of the diaphragm beneath the phase plug in order to produce optimal sound frequency response and sound radiation pattern. For example, the distance may be several millimeters varying from periphery to the apex of the screen 100.

The protective screen 100 may be used with tweeters and midranges, the size of the screen may range from a few millimeters to several hundred millimeters.

The scope of the claims should not be limited by the embodiments set forth in the examples, but should be given the broadest interpretation consistent with the specification as a whole.

We claim:

1. A protective screen for a diaphragm of a loudspeaker, the protective screen comprising:

a first side and a second side;

an imperforated region for suppressing sound waves radiated from a first portion of the diaphragm; and a perforated region comprising a plurality of perforations, the perforations being arranged on a set of concentric circular rings surrounding the imperforated region, each perforation passing through the first side and the second side of the screen, each perforation allowing sound waves radiated from a second portion of the diaphragm to pass through the screen wherein the set of concentric circular rings includes a first ring adjacent to the imperforated region and a second ring adjacent to a periphery of the screen, wherein the perforations on the first ring have a first size, and the perforations on the second ring have a second size, and wherein the second size is larger than the first size.

2. The protective screen of claim 1, wherein sizes of the perforations of the set of concentric circular rings gradually decrease from the periphery of the screen toward the imperforated region.

3. The protective screen of claim 1, wherein the imperforated region comprises a ring with a central opening.

4. The protective screen of claim 1, wherein the imperforated region is substantially located at a center of the screen.

5. The protective screen of claim 1, wherein the size of a perforation on a ring is selected based on a ratio of open area of the ring relative to an overall area of the ring.

6. The protective screen of claim 1, wherein a total number of the rings is selected based on an overall size of the screen and a size of the imperforated region.

7. The protective screen of claim 1, wherein the set of concentric circular rings comprises at least 2 rings.

8. The protective screen of claim 1, wherein the set of concentric circular rings comprises 7 rings.

9. The protective screen of claim 1, wherein the perforations are arranged in a radial pattern from the imperforated region to the periphery of the screen.

10. The protective screen of claim 1, wherein the thickness of the screen is 1 mm.

11. The protective screen of claim 1, wherein the protective screen has a convex dome shape.

12. The protective screen of claim 1, wherein the protective screen has a concave dome shape.

13. The protective screen of claim 1, wherein the protective screen has a flat shape.

14. The protective screen of claim 1, wherein the screen is made of metals.

15. The protective screen of claim 1, wherein the screen is made of polymers.

16. The protective screen of claim 1, wherein the loudspeaker is a high frequency loudspeaker.

17. A loudspeaker assembly comprising:

a loudspeaker having a diaphragm and a protective screen for the diaphragm, the protective screen comprising a first side and a second side;

an imperforated region for suppressing sound waves radiated from a first portion of the diaphragm; and a perforated region comprising a plurality of perforations, the perforations being arranged on a set of concentric circular rings surrounding the imperforated region, each perforation passing through the first side and the second side of the screen, each perforation allowing sound waves radiated from a second portion of the diaphragm to pass through the screen;

wherein the set of concentric circular rigs includes a first ring adjacent to the imperforated region and a second ring adjacent to a periphery of the screen, wherein the perforations on the first ring have a first size, and the perforations on the second ring have a second size and wherein the second size is larger than the first size.

18. The loudspeaker assembly of claim 17, wherein the protective screen is securely mounted in front of the diaphragm.

19. The protective screen of claim 5, wherein open area ratios increase from 0.5 of an innermost ring to 0.8 of an outermost ring, with a step of 0.05 between two adjacent rings.

20. The loudspeaker assembly of claim 1, wherein a total number of the rings is selected based on the material of the screen, the thickness of the screen, the minimum size of the perforations that can be manufactured, and the structural integrity of the screen.

* * * * *